United States Patent [19]

Struble

[11] 4,130,237

[45] Dec. 19, 1978

[54] COLLAPSIBLE OR FOLDABLE PACKAGING SLEEVE CONTAINER

[75] Inventor: Glenn E. Struble, Oxford, Ohio

[73] Assignee: Diamond International Corporation, New York, N.Y.

[21] Appl. No.: 820,068

[22] Filed: Jul. 28, 1977

[51] Int. Cl.[2] ..... B65D 5/02; B65D 85/02

[52] U.S. Cl. ..... 229/40; 229/38

[58] Field of Search ..... 229/37, 38, 40

[56] References Cited

U.S. PATENT DOCUMENTS

| | | | |
|---|---|---|---|
| 2,663,489 | 12/1953 | Paige | 229/37 R |
| 3,398,856 | 8/1968 | Graser | 229/40 X |
| 3,512,697 | 5/1970 | Robinson | 229/41 B X |
| 3,679,122 | 7/1972 | Neff | 229/40 |
| 3,705,681 | 12/1972 | Rossi et al. | 229/40 |
| 3,904,029 | 9/1975 | Holtz | 229/38 |

*Primary Examiner*—Davis T. Moorhead

*Attorney, Agent, or Firm*—Karl W. Flocks

[57] ABSTRACT

A collapsible or foldable sleeve container of pasteboard material or the like comprising a back wall panel and at least a pair of side wall panels and a toggle-like snap action closure member on at least one end thereof, which in operation functions to maintain the container in erected condition. The container is foldable to a flat condition with the closure member open. The sleeve container is adaptable to receive contents therefor through either of two ends and once the snap closure member is conditioned to closed condition the container remains in erected condition. The container is adaptable to be laid on its side for frankfurters or stood on end for french fries or the like.

11 Claims, 16 Drawing Figures

COLLAPSIBLE OR FOLDABLE PACKAGING SLEEVE CONTAINER

BACKGROUND OF THE INVENTION

1. Field of the Invention

The present invention relates to sleeve containers of pasteboard material of the "snap-erected" type known and widely in use in the fast food industry and is believed to be best exemplified by art such as Struble U.S. Pat. No. 3,630,430; Goldsholl U.S. Pat. No. 2,966,293; Mendez U.S. Pat. No. 3,684,157; and Buttery et al. U.S. Pat. No. 3,845,897. Because of the competitive nature of the fast food industry, packaging technology has developed rapidly over the last twenty years. The emphasis has continuously been on speedy operation, ease of use, neatness and attractiveness among numerous other desiderata in the packaging technology insofar as the fast food industry the correlative expression. Not mentioned above, but not to be forgotten is the further desideratum of cost in the packaging medium to be used in the industry.

With the above points in mind it may be readily conceded that each of the cited prior art patents discloses a container that is neat and attractive. The characteristics of the prior art containers insofar as their ease of use and propensity toward speedy operation depend on various parameters as type of operation, whether manual or automated, whether individual or assembly line operation, and variations and combinations thereof. As to the cost aspect of a container, this can be frequently envisioned once the design is disclosed. One criterion upon which economy may be realized is the relative simplicity of the device. In other words, the simpler the design, the lesser will be its cost of manufacture.

SUMMARY OF THE INVENTION

The present invention relates to a packaging sleeve that is neat and attractive, one that will enhance and promote the business of the user, namely the fast food retailer not the ultimate consumer of the food. The present invention further relates to a packaging sleeve that is of lower cost and superior to those of the prior art.

OBJECTS OF THE INVENTION

With the foregoing in mind the present invention has been developed to achieve the following objects:

1. A packaging container that is simple and less expensive to manufacture as compared to those of the prior art in the same field of use.

2. A snap-action packaging sleeve that is easier to use, with contents of the container to be insertable from either end if desired.

3. A snap-action packaging sleeve that prior to erection is open at both ends and may be closed at one or both ends, as is consistent with the specific embodiment, after erection and in use.

4. A snap-action packaging container that will readily and automatically lock itself in assembled condition once it is conditioned for use.

5. A collapsible or foldable packaging sleeve that in the flattened folded condition thereof may be neatly stacked and requires a minimum of storage or shipping space compared to the known prior devices.

With the above objects in mind applicant has conceived a very simple packaging medium comprising a pair of side wall panels and at least a back or bottom wall panel and a front or top wall panel foldably connected to one edge of each of the side wall panels which together form a packaging sleeve. The sleeve in the preferred form of the invention includes four panels, as disclosed although more than four panels may be formed in possible variations. The packaging medium as conceived is a through sleeve which may be open at both ends and includes closure means formed in one piece with the sleeve on at least one end thereof or at both ends thereof if desired. The closure means is formed with toggle-like snap-action members which in operation will maintain the erected and closed condition of the sleeve.

BRIEF DESCRIPTION OF THE DRAWINGS

In the accompanying drawings in which two embodiments of the invention as conceived by applicant are illustrated.

DETAILED DESCRIPTION OF THE INVENTION

Figure 1:
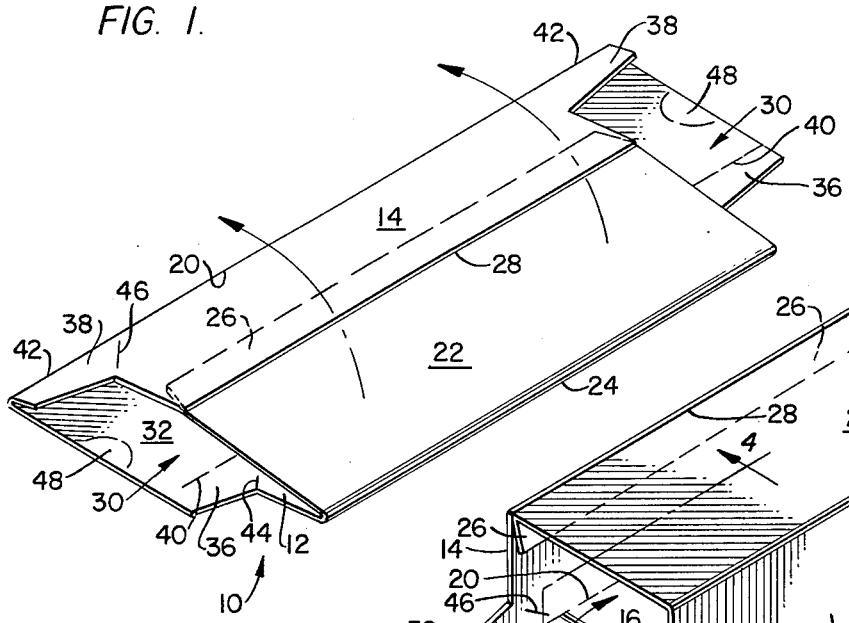
FIG. 1 represents a view in perspective of one embodiment of the packaging sleeve according to the present invention in collapsed or folded flat condition.
Figure 2:
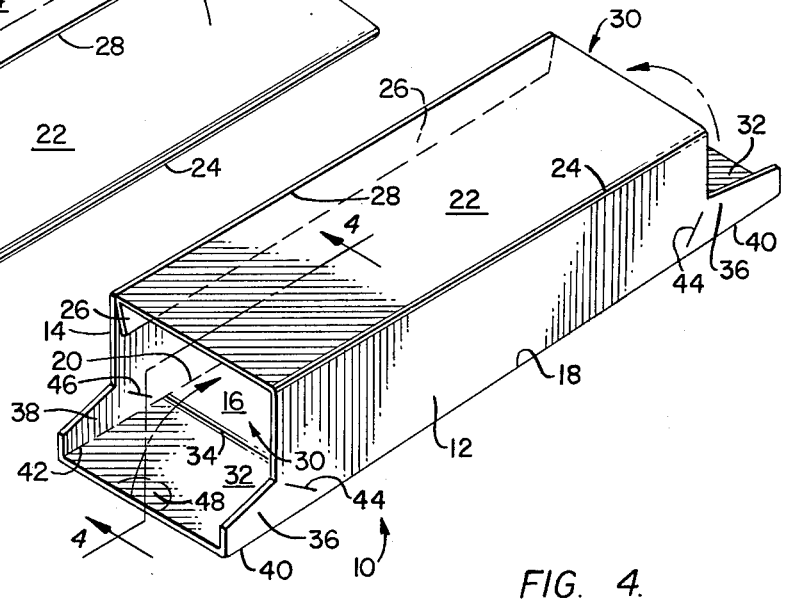
FIG. 2 is a view in perspective of the sleeve of FIG. 1 in erected condition for reception of contents.
Figure 3:
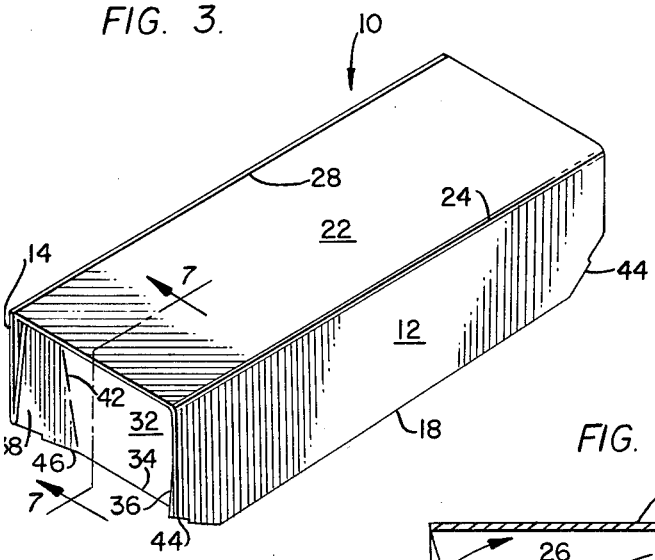
FIG. 3 is a view in perspective of the packaging sleeve of FIG. 2 after closure members thereof have been closed.
Figure 7:
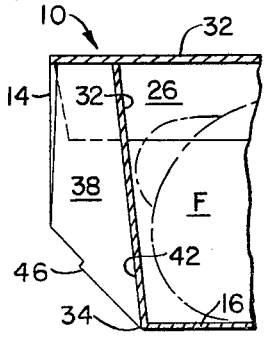
FIG. 7 is a sectional view taken along section 7—7 in FIG. 3.
Figure 8:
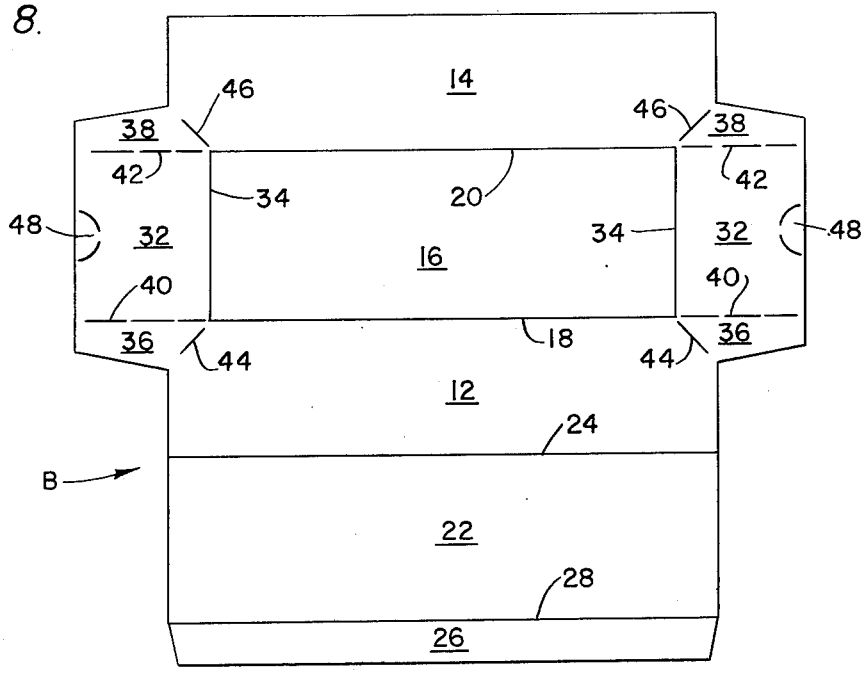
FIG. 8 is a plan view of a blank from which the sleeve of FIG. 1 may be assembled.
Figure 9:
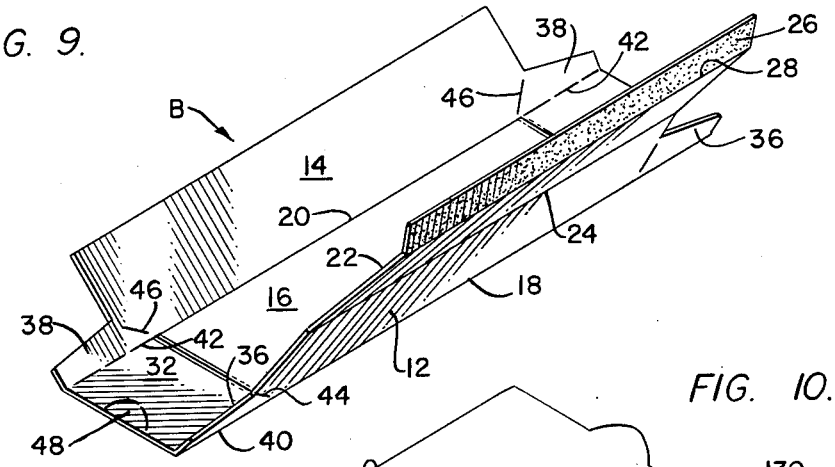
FIG. 9 is a view in perspective of the blank of FIG. 8 in partially folded condition for assembly.

Referring now in greater particularity to FIGS. 1-7, one may readily visualize a first embodiment of the present invention which is assembled from a blank B illustrated in FIGS. 8 and 9. The packaging container or sleeve 10 as seen in FIGS. 1 and 2 comprises a pair of side wall panels 12, 14 and at least a back wall panel 16 foldably connected to one edge 18 or 20 of the side wall panels 12, 14. Sleeve 10 is also seen to include a front wall panel 22 which is foldably connected to side wall panel 12 along one edge 24 and to an assembly panel 26 along the opposite edge 28. The sleeve 10 is assembled when assembly panel 26 is secured to the inside surface of side wall panel 14, for example by adhesive applied therebetween or by other conventional means.

The assembled sleeve 10 can be seen in the folded flat condition for shipment or storage in FIG. 1 and in the erected condition prior to use in FIG. 2. The assembled sleeve 10 includes entrance ways 30 which are in communication with each other through the interior thereof whereby the intended contents may be inserted or removed from either end of the sleeve 10. At the near end of sleeve 10 in FIGS. 1 and 2 closure means may be seen to be integrally formed with sleeve 10 comprising a main closure flap 32 extending from back wall panel 16 along a first hinge line 34, and a single pair of distinct auxiliary flaps 36, 38 hingedly connected to main flap 32 along second hinge lines 40, 42 at opposite sides of the main flap 32. In the folded flat condition of sleeve 10 hinge lines 40, 42 are extensions along edges 18, 20, respectively. Each of the auxiliary flaps 36, 38 is also hingedly connected to one side wall panel 12, 14 along a diagonal hinge 44, 46 extending forwardly from back wall panel 16 at edges 18, 20, respectively. While the near end of sleeve 10 as seen in FIGS. 1 and 2 is provided with the closure means described, it is optional as to whether similar closure means are to be provided at the opposite end of sleeve 10 as illustrated.

To erect container sleeve 10 for use pressure is applied between edges 20 and 24 in FIG. 1 whereupon panels 12, 14 and 20 will be erected in the direction of arrows in FIG. 1 to the condition in FIG. 2 for use, at which time prepared food such as a frankfurter may be inserted through either entrance way 30. To close entrance way 30 main panel 32 is lifted in the direction of the arrow in FIG. 2 and caused to hinge about first hinge line 34 approximately 90° and move inwardly of entrance way 30. As main flap 32 is lifted in the direction of the arrow in FIG. 2 toward its close position, each auxiliary flap 36, 38 is simultaneously automatically caused to hinge outwardly about its second hinge line 40, 42 and fold around its diagonal hinge 44, 46, respectively. In the closed condition of main flap 32, each auxiliary flap 36, 38 is urged to a position of substantially 180° from the open position thereof and in the closed position is in contact against the adjacent inside surface of a side wall panel 12, 14, respectively.

Figure 4:
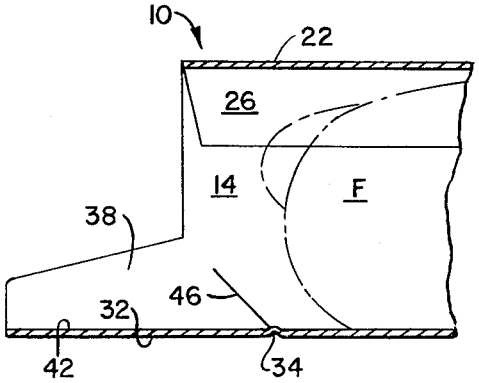
FIG. 4 is a sectional view taken along section 4—4 in FIG. 2 with a portion of the sleeve broken away.
Figure 5:
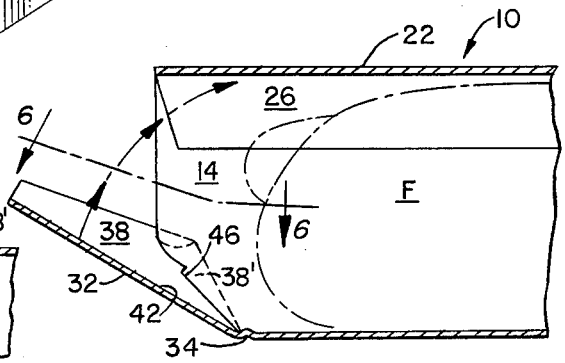
FIG. 5 is a sectional view similar to FIG. 4 but with the closure member on its way from open condition toward closed condition.
Figure 6:
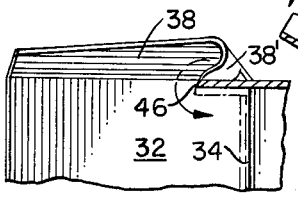
FIG. 6 is a view taken along section 6—6 in FIG. 5.

As described, when the closure means is moved toward its closed condition, main flap 32 is hinged inwardly and each auxiliary flap 36, 38 is simultaneously automatically caused to hinge outwardly, there are in a sense counteracting forces such as in a mechanical toggle joint wherein the parts snap through a center position into an automatic self-imposed locked condition. The closing action of sleeve 10 is depicted in FIGS. 4–7. FIG. 4 shows sleeve 10 with a frankfurter F therein and main flap 32 and auxiliary flap 38 in the open condition. As closing of main flap 32 and auxiliary flap 38 progresses to the stage in FIGS. 5 and 6 a portion 38′ of auxiliary flap 38 adjacent to diagonal hinge 46 snaps in a twisting action about hinge 46 so that what ordinarily would be the inside surface of auxiliary flap 38 is folded 180° and facing outwardly against the inside surface of side wall panel 14 instead of facing inwardly of the sleeve 10. In the closed condition of entranceway 30 sleeve 10 as illustrated in FIG. 7, the outside surface of auxiliary flap 38 is facing inwardly while the inside surface thereof is facing outwardly. Also, as may be seen in FIG. 2 back wall panel 16 is formed with the first hinge line 34 extending inwardly of sleeve 10 from the end extremities of side wall panels 12, 14 and front wall panel 22 so that the entranceway 30 is completely closed by main flap 32. The foregoing description of the closing operation of auxiliary flap 38 is intended to also be descriptive with sister auxiliary flap 36.

To facilitate opening main flap 32 from its closed position, a die cut punch out portion 48 is provided whereby with the portion 48 punched out a finger may be inserted in the notch left thereat to allow pulling main flap 32 outwardly to gain access to the contents of sleeve 10. Optionally, assembly panel 26 may be pulled apart from side wall panel 14 to form a food supporting tray.

FIGS. 8 and 9 show a blank B from which sleeve 10 may be assembled. Blank B comprises what constitutes a back wall panel 16 and at least a pair of side wall panels 12, 14 integral therewith and extending along opposite edges 18, 20, respectively. Blank B is formed with a main closure flap 32 extending integrally therewith along a first hinge line 34 at each end thereof as illustrated, but may optionally be formed with such a main flap 32 at only one end thereof. Each main flap 32 is formed with a pair of auxiliary flaps 36, 38 integral therewith along second hinge lines 40, 42, respectively, on opposite sides thereof. Each auxiliary flap 36, 38 also extends in hinged relationship with a side wall panel 12, 14 along a diagonal hinge 44, 46 which extends from back wall panel 16 at the end of edges 18, 20 along an end portion of side wall panel 12, 14, respectively. The free end of each side wall panel 12, 14 and main closure flap 32 associated therewith project outwardly to a greater distance from the longitudinal mid-point of the sleeve 10 to be formed thereby than the adjacent end of back wall panel 16 so that diagonal hinges 44, 46 extend outwardly from back wall panel 16 to the adjacent ends of side wall panels 12, 14, respectively. Side wall panel 12 in addition to having an edge 18, along which it extends from back wall panel 16, also includes a front wall panel 22 integrally joined thereto along an edge 24 opposite from edge 18. Front wall panel 22 in turn includes an assembly panel 26 extending along an edge 28 opposite to edge 24. Main flap 32 is provided with a diescored punch out portion 48 which facilitates opening main closure flap 32. Assembly of blank B into sleeve 10 of FIG. 1 is readily achieved by folding panels 22 and 26 together along edge 24, folding panel 14 along edge 20 over panel 26 and securing panels 14 and 26 together as by adhesive means.

Figure 14:
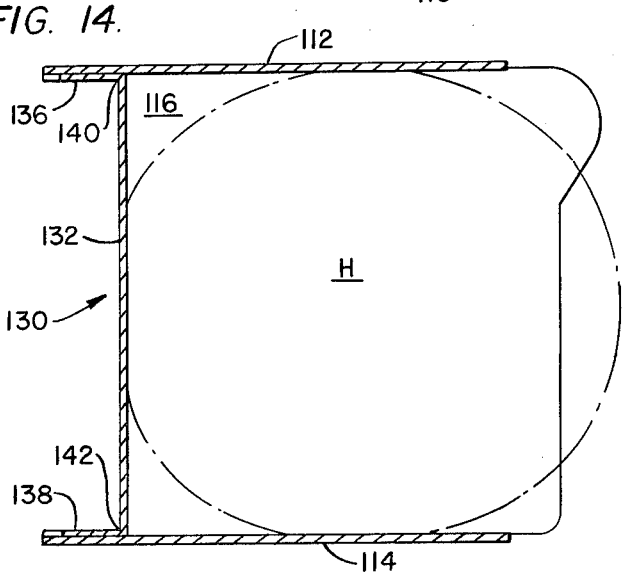
FIG. 14 is a sectional view taken along section 14—14 in FIG. 13.

An alternative form of the invention described above is illustrated in FIGS. 10–16 in which a hamburger, for example, may be compactly contained instead of a frankfurter. The alternative embodiment of the present invention is seen to be a sleeve 110 in partially erected condition in FIG. 10 and in fully erected condition in FIG. 11 with the outline of a hamburger H therein. Sleeve container 110 is seen to be not quite as long as sleeve 10 illustrated in FIGS. 1–9 and also more closely squared in horizontal section as may be seen in FIG. 14.

Figure 10:
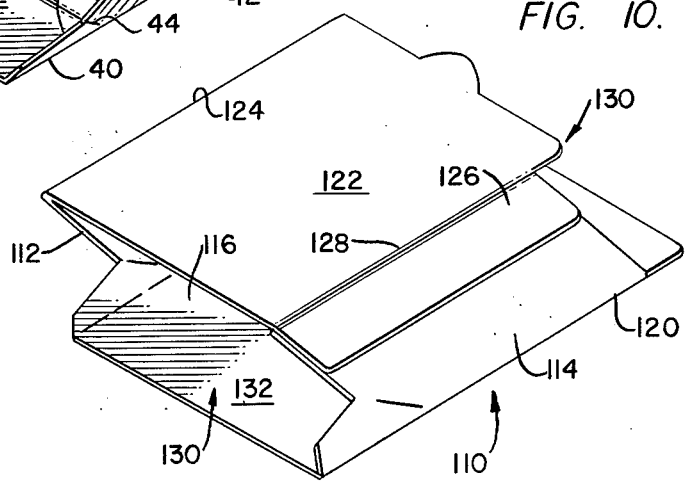
FIG. 10 is a view in perspective of an alternative embodiment of the present invention in partially erected condition.
Figure 11:
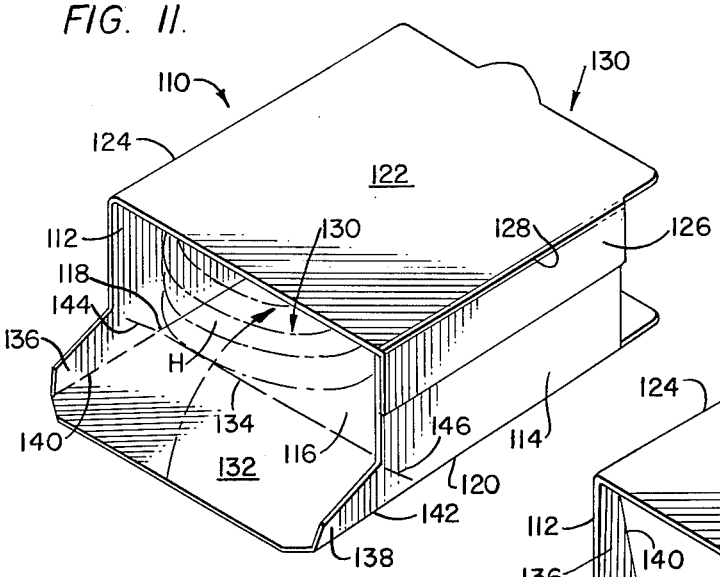
FIG. 11 is a view in perspective of the packaging sleeve of FIG. 10 in fully erected condition prior to closing up the visible end.
Figure 15:
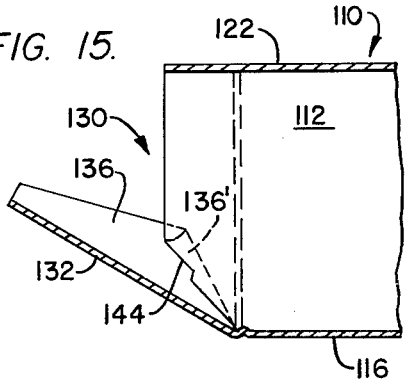
FIG. 15 is a sectional view similar to FIG. 5, but showing the closure member of the sleeve of FIG. 13 prior to being closed.
Figure 16:
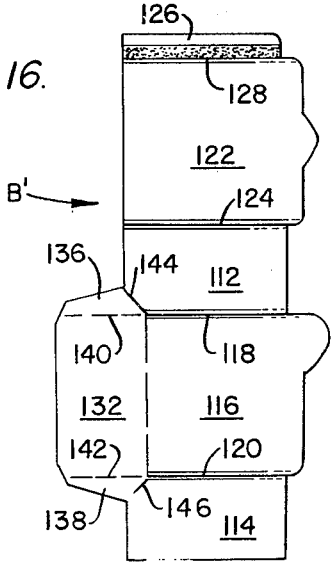
FIG. 16 is a plan view of a blank from which the sleeve of FIG. 10 may be assembled.

Referring now in greater particularity to FIGS. 10–15, one may readily visualize a second embodiment of the present invention which is assembled from a blank B′ illustrated in FIG. 16. The packaging container or sleeve 110 as seen in FIGS. 10 and 11 comprises a pair of side wall panels 112, 114, and at least a back wall panel 116 foldably connected to one edge 118 or 120 of the side wall panels 112, 114. Sleeve 110 is also seen to include a front wall panel 122 which is foldably connected to side wall panel 112 along one edge 124 and to an assembly panel 126 along the opposite edge 128. The sleeve 110 is assembled when assembly panel 126 is secured to the inside surface of side wall panel 114, in any manner similar to that described in the first embodiment of the present invention.

The assembled sleeve 110 can be seen in a partially collapsed condition in FIG. 10 and in the erected condition for use in FIG. 11. The assembled sleeve 110 includes entrance ways 130 which are in communication with each other through the interior thereof whereby the intended contents may be inserted or removed from either end of the sleeve 110. At the near end of sleeve 110 in FIGS. 10 and 11 closure means may be seen to be integrally formed with sleeve 110 comprising a main closure flap 132 extending from back wall panel 116 along a first hinge line 134, and a pair of auxiliary flaps 136, 138 hingedly connected to main flap 132 along second hinge lines 140, 142 at opposite sides of the main flap 132. In the folded flat condition of sleeve 110 hinge lines 140, 142 would be extensions along edges 118, 120, respectively. Each of the auxiliary flaps 136, 138 is also hingedly connected to one side wall panel 112, 114 along a diagonal hinge 144, 146 extending forwardly from back wall panel 116 at edges 118, 120, respectively. While only the near end of sleeve 110 as seen in FIG. 11 is provided with the closure means described, it is optional as to whether similar closure means are to be provided at the opposite end of sleeve 110.

To erect container sleeve 110 for use pressure is applied between edges 120 and 124 in FIG. 10 whereupon panels 112, 114 and 120 may be fully erected from the partially erected condition of FIG. 10 to the fully erected condition illustrated in FIG. 11 for use, at which time prepared food such as a hamburger may be inserted through either entrance way 130. To close entrance way 130 main panel 132 is lifted in the direction of the arrow in FIG. 11 and caused to hinge about first hinge line 134 approximately 90° and move inwardly of entrance way 130. As main flap 132 is lifted in the direction of the arrow in FIG. 11 toward its closed position, each auxiliary flap 136, 138 is simultaneously automatically caused to hinge outwardly about its second hinge line 140, 142 and fold around its diagonal hinge 144, 146, respectively. In the closed condition of main flap 132, each auxiliary flap 136, 138 is urged to a position of substantially 180° from the open position thereof and in the closed position is in contact against the adjacent inside surface of a side wall panel 112, 114, respectively.

Figure 12:
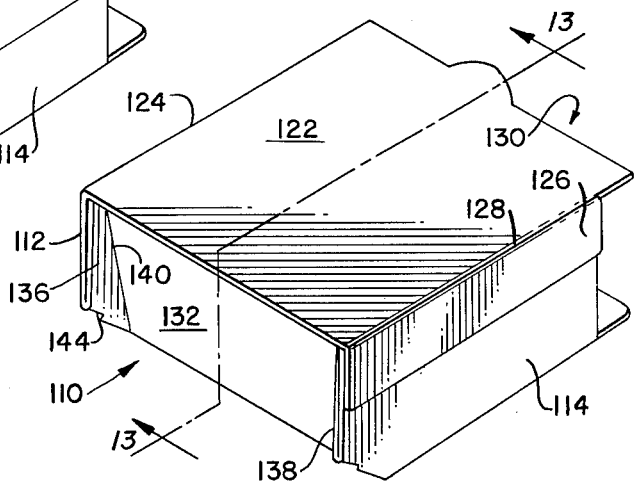
FIG. 12 is a view in perspective of the packaging sleeve of FIG. 10 in fully erected condition with the visible end closed.
Figure 13:
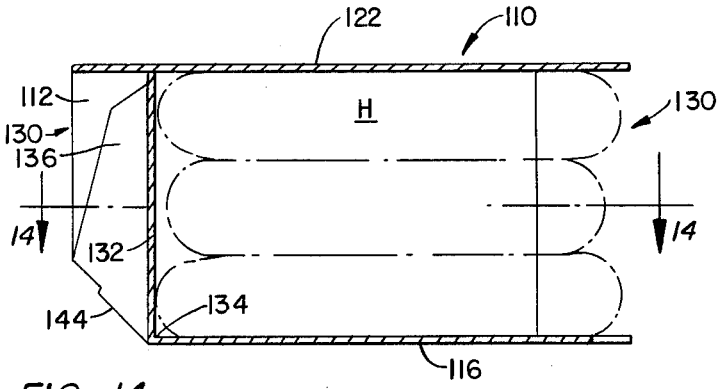
FIG. 13 is a sectional view taken along section 13—13 in FIG. 12.

As described, when the closure means is moved toward its closed condition, main flap 132 is hinged inwardly and each auxiliary flap 136, 138 is simultaneously automatically caused to hinge outwardly, there are the counteracting forces as mentioned in a mechanical toggle joint wherein the parts snap through a center position into an automatic self-imposed locked condition. The closing action of sleeve 110 is similar to that of sleeve 10 and is depicted in FIG. 15 which shows sleeve 110 with a hamburger H therein and main flap 132 and auxiliary flap 136 in the open condition. As closing of main flap 132 and auxiliary flap 136 progresses to the stage, a portion 136' of auxiliary flap 136 adjacent to diagonal hinge 144 snaps in a twisting action about hinge 144 so that what ordinarily would be the inside surface of auxiliary flap 136 is folded 180° and facing outwardly against the inside surface of side wall panel 112 instead of facing inwardly of the sleeve 110. In the closed condition of entrance way 130 sleeve 110, as illustrated in FIG. 12, the outside surface of auxiliary flap 136 is facing inwardly while the inside surface thereof is facing outwardly. Also, as may be seen in FIGS. 11 and 13 back wall panel 116 is formed with the first hinge line 134 extending inwardly of sleeve 110 from the end extremities of side wall panels 112, 114 and front wall panel 122 so that the entrance way 130 is completely closed by main flap 132. The foregoing description of the closing operation of auxiliary flap 136 is intended to also be descriptive with sister auxiliary flap 138.

FIG. 16 shows a blank B' from which sleeve 110 may be assembled. Blank B' comprises what constitutes a back wall panel 116 and at least a pair of side wall panels 112, 114 integral therewith and extending along opposite edges 118, 120, respectively. Blank B' is formed with a main closure flap 132 extending integrally therewith along a first hinge line 34 at one end thereof as illustrated, but may optionally be formed with a similar main flap 132 at the other end thereof. Main flap 132 is formed with a pair of auxiliary flaps 136, 138 integral therewith along second hinge lines 140, 142, respectively, on opposite sides thereof. Each auxiliary flap 136, 138 also extends in hinged relationship with a side wall panel 112, 114 along a diagonal hinge 144, 146 which extends from back wall panel 116 at the end of edges 118, 120 along an end portion of side wall panel 112, 114, respectively. The free end of each side wall panel 112, 114 and main closure flap 132 associated therewith projects outwardly to a greater distance from the longitudinal mid-point of the sleeve 110 to be formed thereby than the adjacent end of back wall panel 116 so that diagonal hinges 144, 146 extend outwardly from back wall panel 116 to the adjacent ends of side wall panels 112, 114, respectively. Side wall panel 112 in addition to having an edge 118 along which it extends from back wall panel, also includes a front wall panel 122 integrally joined thereto along an edge 124 opposite from edge 118. Front wall panel 122 in turn includes an assembly panel 126 extending along an edge 128 opposite to edge 124.

Assembly of blank B' into sleeve 110 of FIG. 10 is readily achieved by folding panels 122 and 126 together along edge 124, folding panel 114 along edge 120 and securing panels 114 and 126 together as by adhesive means, for example with panel 126 secured over an adjacent portion of panel 114.

While the sleeve container as illustrated includes four wall panels, namely a back wall panel, a pair of side wall panels, and a front wall panel, it is to be understood that it is within the concept of the present invention to form a sleeve container with at least a back wall panel and a pair of side wall panels. It is further within the contemplation of the present invention to separate the assembly panel from the panel to which it is secured to form a tray from which food may be consumed.

It will be obvious to those skilled in the art that various changes may be made without departing from the scope of the invention and the invention is not to be considered limited to what is shown in the drawings and described in the specification.

What is claimed is:

1. A collapsible or foldable packaging sleeve-like container of pasteboard material or the like comprising:

(a) a pair of side wall panels;

(b) at least a back wall panel and a front wall panel each of which is foldably connected to one edge each of said side wall panels; and (c) snap closure means for at least one end of said container including a main flap extending from said at least one end of said back wall panel along a first hinge line and a single distinct auxiliary flap at opposite sides of said main flap, each of said auxiliary flaps being hingedly connected to said main flap along a second hinge line at said opposite sides of said main flap and also hingedly connected to each of said side wall panels along a diagonal hinge extending forwardly from said back wall panel to an adjacent free edge of the respective side wall panel associated therewith;

said closure means being open in the collapsed or folded condition of said container and ready to be closed when said container is initially erected to an upstanding condition to receive an article therein;

said closure means being closed by rotating said main flap inwardly of said container about said first hinge line on the order of about 90° whereby each of said auxiliary flaps will simultaneously automatically rotate about the respective second hinge line and about the respective diagonal hinge structurally associated therewith in a toggle-like snap locking action to maintain itself in closed condition, each of said auxiliary flaps being hinged outwardly about said second hinge line and folded around its said diagonal hinge to a position of substantially 180° into contact against the adjacent inside surface of one of said side wall panels when said main flap is closed.

2. The container as defined in claim 1 wherein said first hinge line at said one end of said back wall panel is located closer to the longitudinal center of said container than either adjacent free end of said side wall panels and said main flap is rotated about said first hinge line on the order of about 90° from its open position to its closed position and said side wall panels project outwardly beyond said main flap in the closed position of said main flap.

3. The container as defined in claim 1 wherein said first hinge line extends along an end of said back wall panel with said end of said back wall panel being located intermediate opposite end of each of said side wall panels and said main flap is rotated about said first hinge line on the order of about 90° from its open position to its closed position and said side wall panels embrace opposite sides of said main flap in the closed condition thereof.

4. The container as defined in claim 3 wherein said front wall panel includes an end portion projecting beyond said main flap in the closed condition thereof to provide an overhang enclosure relationship therewith.

5. The container as defined in claim 3 wherein said main flap has a geometric configuration commensurate with the cross-sectional configuration formed by said wall panels in the erected condition thereof and over which said main panel is to serve as a closure.

6. The container as defined in claim 5 wherein said main panel is provided with a readily punched-out notch to facilitate insertion of a finger for an opening operation.

7. The container as defined in claim 3 wherein said container includes second snap closure means of like structure to that of said closure means at said one end of said container but formed at the opposite end of said container to provide a completely enclosable space.

8. A blank of pasteboard material or the like for forming a collapsible or foldable flat packaging sleeve container having a through opening comprising a first generally rectangular panel, a pair of generally rectangular side wall panels extending from opposite side edges of said first panel, a generally rectangular main closure flap integral with at least one end of said first panel along a first hinge line, a single distinct auxiliary flap at opposite sides of said main flap, each of said auxiliary flaps being integral with said main closure flap on opposite sides thereof along second hinge lines, said auxiliary flaps each also being integral with one of said side wall panels along a diagonal hinge extending from the adjacent end of said first panel to the adjacent end of the respective one of said side wall panels, and a fourth generally rectangular panel integral with one of said pair of side wall panels along an edge opposite from the edge at which said one side wall panel extends from the first panel.

9. The blank as defined in claim 8 wherein said auxiliary flaps extend from end portions of said side wall panels which are farther from the longitudinal mid-point of the sleeve to be formed by said blank than the adjacent end of said first panel is from said mid-point.

10. The blank as defined in claim 8 wherein an assembly panel extends from an edge of at least one of said side wall panels or from said fourth panel.

11. The blank as defined in claim 10 wherein a second main closure flap and a second pair of auxiliary flaps are provided at the opposite end of said first wall panel and said pair of side wall panels.

* * * * *